United States Patent [19]

Smojver

[11] Patent Number: 4,471,738

[45] Date of Patent: Sep. 18, 1984

[54] METHOD AND APPARATUS FOR MINIMIZING THE FUEL USAGE IN AN INTERNAL COMBUSTION ENGINE

[75] Inventor: Radmil R. Smojver, Novato, Calif.

[73] Assignee: Emission Control Systems, Inc., Novato, Calif.

[21] Appl. No.: 417,693

[22] Filed: Sep. 13, 1982

[51] Int. Cl.[3] ..... F02D 33/00

[52] U.S. Cl. ..... 123/440; 123/349; 123/489; 60/276; 73/23

[58] Field of Search ..... 123/440, 489, 589, 349; 60/276; 250/343; 73/23

[56] References Cited

U.S. PATENT DOCUMENTS

| | | | |
|---|---|---|---|
| 2,773,349 | 12/1956 | Bollo et al. | 250/343 |
| 3,362,387 | 1/1968 | Neumann et al. | 123/440 |
| 3,593,023 | 7/1971 | Fullerton et al. | 73/23 |
| 3,723,047 | 3/1973 | Baudelet de Livois | 431/76 |
| 3,738,341 | 6/1973 | Loos | 123/440 |
| 4,162,889 | 7/1979 | Shigemura | 431/76 |
| 4,257,258 | 3/1981 | Bovenlander | 73/23 |
| 4,265,208 | 5/1981 | Emmert et al. | 123/440 |
| 4,274,376 | 6/1981 | Tsiang et al. | 123/349 |
| 4,398,514 | 8/1983 | Nakamura | 123/339 |

*Primary Examiner*—Andrew M. Dolinar

*Attorney, Agent, or Firm*—Limbach, Limbach & Sutton

[57] ABSTRACT

An apparatus and method is disclosed for minimizing the fuel usage in an internal combustion engine. The subject invention is particularly adapted for use with an engine installation subject to varying loads and which includes a governor for varying fuel flow as a function of load. In operation, the combustibles in the exhaust gas of the engine is continuously monitored. The measured level of combustibles is then compared with a predetermined level corresponding to optimum efficiency. A controller is provided for varying the air/fuel ratio supplied to the engine for maximizing efficiency in correspondence with the preset level. By this arrangement, energy output is increased permitting the governor to further reduce fuel flow, thereby minimizing energy costs.

6 Claims, 3 Drawing Figures

METHOD AND APPARATUS FOR MINIMIZING THE FUEL USAGE IN AN INTERNAL COMBUSTION ENGINE

The subject invention relates to an apparatus and method for minimizing the fuel usage in an internal combustion engine. The subject invention is particularly adapted for use in an engine installation subject to varying loads. More specifically, in an engine system having a governor for adjusting the fuel flow as a function of load, the subject invention is intended to fine tune the fuel supply to maximize efficiency.

BACKGROUND OF THE INVENTION

There has always been considerable interest in developing methods and apparatus for maximizing the efficiency of energy generating devices. Recently, with the escalating price of fuel, it has become apparent that improvements in efficiency can translate into large cost savings.

Examples of recently developed devices for enhancing the efficiency of energy generating devices can be found in Baudelet De Livois U.S. Pat. No. 3,723,047, issued Mar. 27, 1973; and Shigemura U.S. Pat. No. 4,162,889, issued July 31, 1979. Both of these patents disclose feedback systems for use with furnaces. More particularly, in a prior art feedback system, combustibles in the exhaust line are monitored to determine the efficiency of the engine. If the engine is not burning at maximum efficiency, the air flow to the furnace is adjusted. By adjusting the air flow, efficient burning can be achieved based on a given flow rate of fuel.

Both the above-cited prior art systems are particularly adapted for use with furnace installations where heat is produced to generate steam. Typically, furnace installations are operated at maximum power at all times. Thus, the fuel input rate is held relatively constant, while the air input is adjusted to insure efficient burning. The previously cited patent to Shigemura provides a detailed explanation of the theories of efficient combustion and is incorporated herein by reference.

A furnace installation is typically designed to operate most efficiently at full power. The steam output from the furnace is used to operate various types of machinery. In addition, the steam output can be used to drive turbines for the generation of electricity. In operation, when demand from the machinery drops, the excess steam is simply gated to the turbines to generate electricity. Thus, the system can be operated at full power at all times with no waste of generated steam.

A different situation exists in an installation utilizing an internal combustion engine because there is no easy means for utilizing its excess power capacity. In a typical situation, such as a refinery setting, an internal combustion engine is arranged to power a set of machines which are cycled on and off during the work day. Since the engine is called upon to deliver a wide range of power outputs based on the varying loads, it would be extremely inefficient to run an internal combustion engine at full power during times of reduced load.

Accordingly, in most known internal combustion engine installations, a means is provided for sensing the load on the engine and regulating the fuel flow as a function thereof. This means is generally referred to as a governor and controls the flow of fuel in response to the load on the engine. Unfortunately, the governors found in the prior art consist of relatively crude linkage arrangements which are only capable of making gross adjustments to the flow of fuel.

The inability of the governor to provide accurate adjustments is one factor which, in combination, gives rise to inefficient operation. Another factor contributing to this problem is that the engine must never be supplied with less fuel than is necessary to support the load. More particularly, the engine will tend to stall if supplied with too little fuel, thereby interrupting operations. Accordingly, if the governor were calibrated to closely follow the load, its inherent inaccuracy would frequently result in the stalling of the engine. Thus, in practice, the governor is typically calibrated to deliver slightly more fuel than necessary to prevent stalling. As can be appreciated, the extra fuel supply represents wasted energy.

Another shortcoming associated with the prior art devices relates to the adjustment of the air/fuel ratio. More particularly, in order to obtain maximum performance of an engine, all adjustments, including the air/fuel ratio, are made based on the full load condition. The air/fuel ratio is typically adjusted through a carburetor system wherein fuel flow from the governor is supplied to a carburetor which mixes in air to permit combustion.

In operation, when the governor senses a reduction in the load, it functions to reduce the fuel flow to the carburetor. Since the air/fuel ratio at the carbureator has been adjusted based on maximum fuel flow, the resulting mixture associated with the reduced fuel flow condition will not achieve maximum combustion efficiency.

Accordingly, it would be desirable to provide a method for optimizing the efficiency of an internal combustion engine. Unfortunately, the devices found in the prior art, designed for furnace control, are not suitable for this purpose. More particularly, the prior art devices are designed merely to regulate air flow to a furnace which is being supplied with a relatively constant fuel flow. In contrast, the subject invention is intended to minimize fuel usage in an internal combustion engine subject to varying loads.

Accordingly, it is an object of the subject invention to provide a new and improved apparatus and method for minimizing the fuel usage, in an internal combustion engine system, which is subject to varying load conditions.

It is a further object of the subject invention to provide a new and improved apparatus for minimizing fuel usage in an engine system which includes a governor for adjusting the rate of flow of fuel as a function of load.

It is another object of the subject invention to provide a new and improved apparatus which continuously monitors the combustibles in the exhaust output of an internal combustion engine to premit the fine tuning of the fuel supply for maximizing efficiency.

It is still a further object of the subject invention to provide a new and improved method for continuously monitoring the combustibles in the exhaust output of an internal combustion engine, which functions in combination with a governor to fine tune the fuel supply for maximizing efficiency.

It is still another object of the subject invention to provide an apparatus and method which also improves air quality of the exhaust of an engine and reduces maintenance problems.

SUMMARY OF THE INVENTION

In accordance with these and many other objects, the subject invention is defined by a continuous feedback apparatus intended to work in conjunction with an internal combustion engine having a governor adapted to adjust the fuel supply as a function of load. More particularly, a governor is provided which senses the demand on the engine and restricts the flow of fuel in rough correspondence to the requirements of the engine. When the fuel supply is reduced, the operating efficiency of the engine will drop because the air/fuel ratio has not been adjusted to compensate for the fuel restriction. The latter condition is obviated by the subject invention.

The intended result is achieved by monitoring the level of combustibles in the exhaust output of the engine. The combustible level is compared with a predetermined value corresponding to maximum efficiency. Based on the comparison, the actual fuel flow to the engine is adjusted in order to maximize power output. In the continuous system of the subject invention, when the fuel flow is fine tuned, engine efficiency will increase, enabling the governor to further reduce the flow of fuel, such that total fuel flow to the engine for a given load is minimized.

In the preferred embodiment of the subject invention, the monitor is defined by an infrared, carbon monoxide analyzer which is particularly sensitive to inefficient fuel combustion. In operation, a sample from the exhaust of the engine is supplied to the carbon monoxide analyzer. Prior to its entry into the analyzer, the sample is conditioned to remove any particulates and moisture which would interfere with the analysis.

Further objects and advantages of the subject invention will become apparent from the following detailed description taken in conjunction with the drawings in which:

DETAILED DESCRIPTION OF THE PREFERRED EMBODIMENTS

Figure 1:
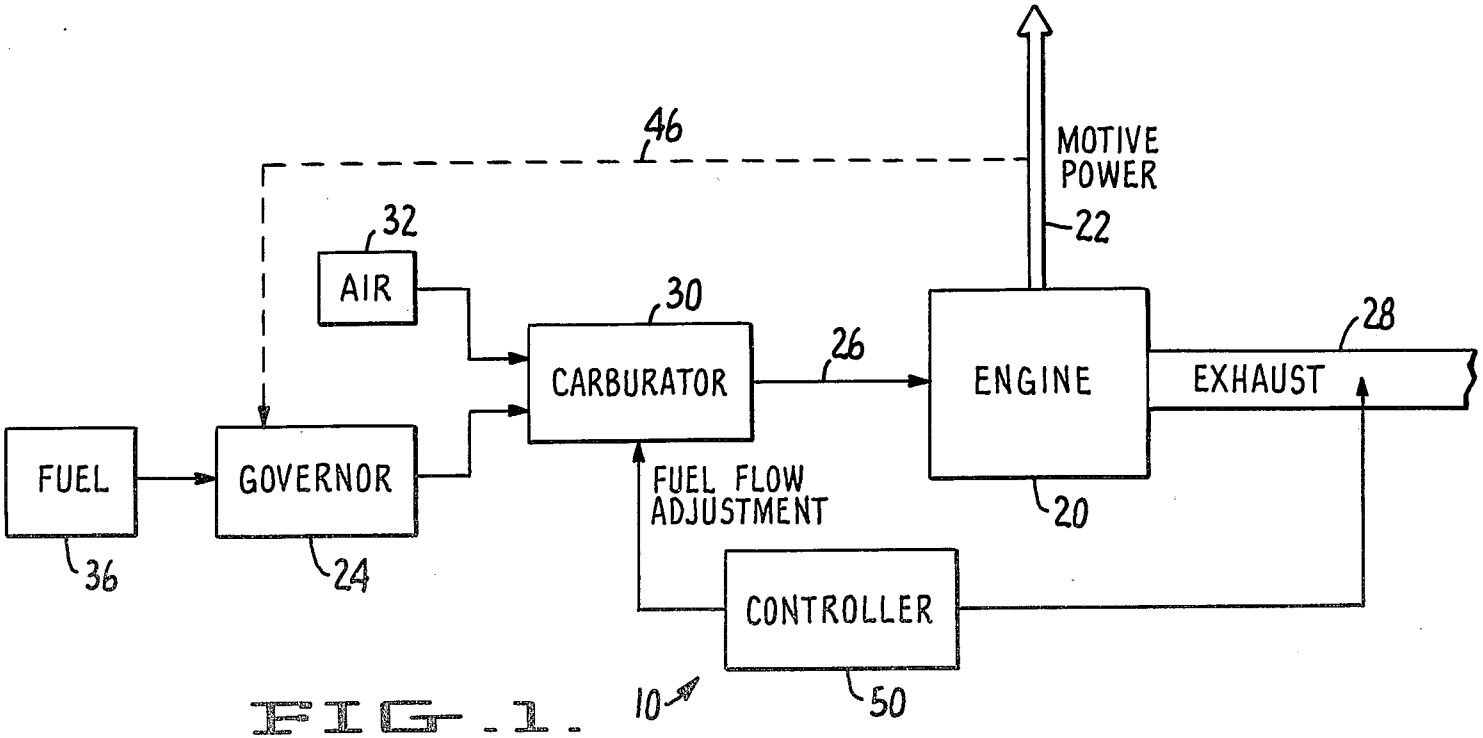
FIG. 1 is a block diagram illustrating the feedback system of the subject invention.

Referring to FIG. 1, there is illustrated a typical power installation which may be used in conjunction with the apparatus and method of the subject invention. More particularly, an internal combustion engine 20 is provided which is adapted to generate power 22 for operating various machinery. As discussed above, in a typical installation, the machinery will operate under numerous on/off duty cycles such that the demand on the engine will vary. Accordingly, in order to create an efficient operating system, it is desirable to reduce the output of the engine as a function of load to minimize fuel usage. As discussed more fully hereinbelow, a governor 24 may be provided for adjusting the rate of fuel flow as a function of the load.

Engine 20 is provided with an air/fuel input 26. The air/fuel mixture is combusted within the engine 20 and exhaust gases are released through outlet 28. The air/fuel imixture is supplied to the engine by a carburetor 30. Carburetor 30 functions to mix air from supply 32 and fuel received from governor 24. Governor 24 controls the flow of fuel between fuel, supply 36 and the carburetor 30.

As discussed above, when the engine is initially tuned, the system is adjusted for peak power. Thus, maximum fuel flow is supplied to the engine in an attempt to generate maximum power output. Carburetor 30 is then adjusted such that air flow provides enough oxygen to create the desired combustion efficiency.

As discussed in the earlier cited patent to Shigemura, maximum efficiency can be obtained by providing an air supply that includes a limited amount of oxygen in excess of the theoretical amount of oxygen required for complete combustion. In practice, even this level of oxygen will not produce complete combustion such that some level of particulates, on the order of a few parts per million, will be expelled into exhaust 28. As pointed out in the Shigemura reference, it is undesirable to provide enough air to insure complete combustion, because a significant amount of wasted energy would be expended to heat the nonoxygen components of the air. Accordingly, in the desirable efficiency range, a measurable amount of particulates will always be present in the exhaust. It is these particulates which can be measured in order to operate the feedback system of the subject invention.

The quantative level of particulates in the exhaust that would correspond to optimum performance will, of course, vary from engine to engine. For example, certain engines are found to run better in either lean or rich burning environments. In any event, the optimum operating condition of a particular engine can nevertheless be correlated to a specific particulate output level. This predetermined particulate output level can be calculated and utilized as a norm for maintaining the optimum setting of the engine. Accordingly, it is to be understood that the subject invention is intended to include normalization around a predetermined level which is suitable to the particular engine installation selected.

Figure 2:
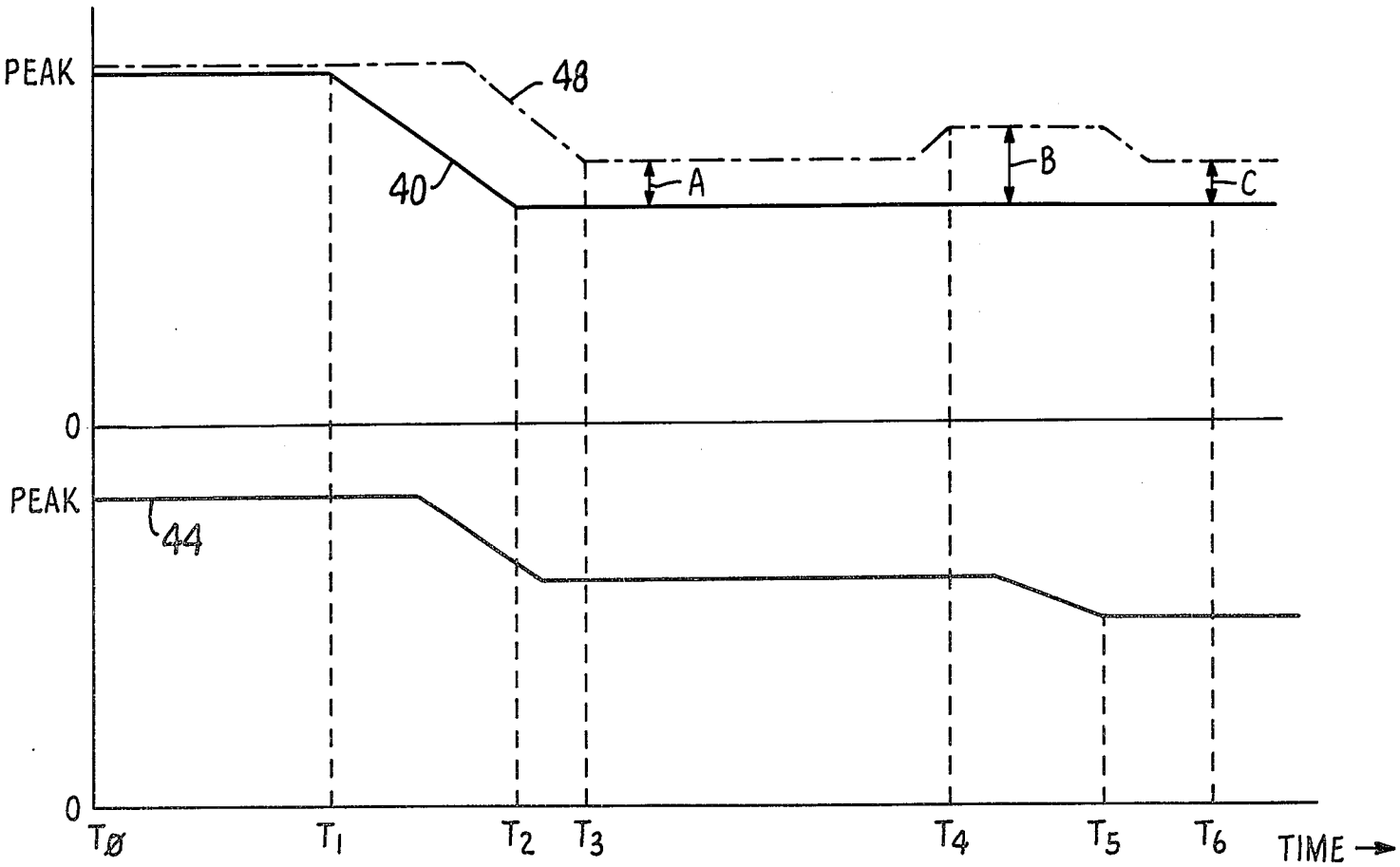
FIG. 2 is a graphical representation illustrating the power output as a function of demand and fuel flow in accordance with apparatus and method of the subject invention.

Referring now to FIG. 2, the operation of a typical engine installation will be discussed. In the graph, the X-axis corresponds to time, while the Y axis is used to illustrate fuel flow from the governor, engine demand and engine output. Curve 40 is intended to illustrate a simplified demand curve of an engine 20. From time $T_{\emptyset}$ to time $T_1$, the engine demand is at a peak level. Between time period $T_1$ and $T_2$, the engine demand level drops and thereafter becomes continuous at a lower level. Of course, in actual practice, the demand will continually vary, however a simplified demand curve is illustrated to clarify the explanation of the subject invention.

Curve 44 is intended to illustrate the fuel flow leaving governor 24 and supplied to carburetor 30. In a typical installation, at peak demand, fuel flow will be at a maximum. As discussed above, governor 24 is provided to restrict fuel flow when demand drops, which begins to occur in the illustrated example at time $T_1$. The information concerning engine demand and resultant output is supplied to governor 24 along line 46, illustrated in FIG. 1. Since this feedback operation takes a finite time period, response is not instantaneous. However, after a short interval, governor 24 functions to restrict the rate of fuel in accordance with the drop in demand on the engine. Accordingly, at some point after $T_2$, the fuel flow to the engine has been reduced a significant amount.

The effect of the reduction in fuel flow can be seen by observing curve 48 which illustrates the energy output available from engine 20. Initially, engine output is at a peak level. However, as the fuel flow is reduced by governor 24, engine output is also reduced. It will be seen that immediately after point $T_3$, a gap A, corresponding to excess power, exists between the output and demand curves. This relationship is unavoidable due to the inherent inaccuracies of the governor. As discussed above, the fuel supply must never be restricted an amount which would bring the demand above the output. The latter situation would result in a stall, interrupting operations and necessitating the restarting of the engine. Thus, a governor is calibrated to insure that the output never drops below the demand. Accordingly, in known prior art systems, the rate of fuel would reach a steady state at a level associated with point $T_3$. As discussed more fully hereinbelow, by utilizing the apparatus and method of the subject invention, fuel flow can be further restricted, thereby saving energy costs.

Referring again to FIG. 1, it will be seen that the subject invention includes a controller 50 which is intended to fine tune the fuel supply to the engine. Controller 50 operates by monitoring the particulates in the exhaust 28 of the engine. The level of particulates are compared to a predetermined value representing the desired operating range of the engine. The controller then functions to fine tune the fuel flow at the carburetor such that the particulate level of the exhaust will be driven to a level corresponding to the preset level. It is intended that the controller function as a continuous feedback arrangement such that fuel flow is continuously minimized.

Referring again to FIG. 2, the effect of providing a controller 50 in conjunction with a prior art engine installation is illustrated. As discussed above, when demand, illustrated by curve 40, drops, the fuel flow from governor 24 is reduced thereby reducing the output from engine 20. At this point, the air/fuel ratio is less than optimum. More particularly, and as pointed out above, carburetor 30 is typically adjusted to provide a particular ratio based on peak engine performance and maximum fuel flow. This ratio will not be the same for the reduced flow which occurs during reduced demand periods. Accordingly, a measurable variation will occur in the particulate level in the exhaust.

This variation is monitored by the controller. In response to this variation, the controller will output a fuel flow adjustment signal to the carburetor. The air/fuel ratio adjustment will in turn result in an increase in the efficiency of the engine. This increase is observed at point $T_4$ where engine output is increased. At this point, the difference between the demand curve 40 and the output curve 48 or excess power is equal to a value B, which is significantly greater than the separation A, illustrated at point $T_3$. This increase of excess power is transmitted back to the governor 24, such that governor 24 may respond by further restricting the flow of fuel. The drop in fuel is indicated at point $T_5$ on curve 44. This drop results in the restoration of the excess power gap to a level C, at point $T_6$, which corresponds to the gap A at point $T_3$. As can be appreciated, the fuel flow after point $T_5$ is at a minimum such that energy savings are maximized.

Figure 3:
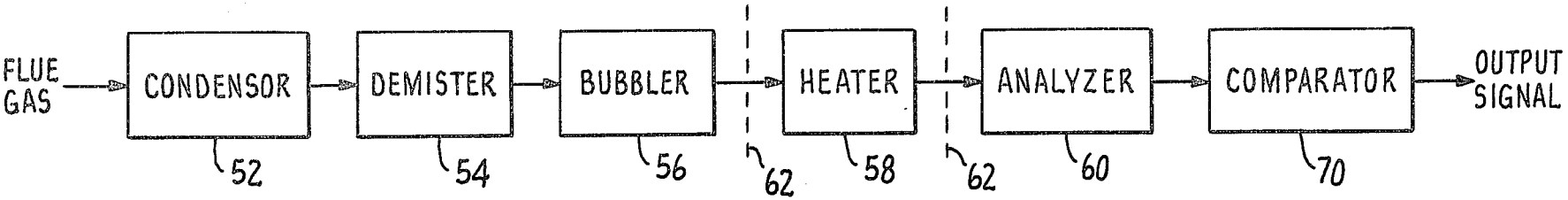
FIG. 3 is a block diagram illustrating the preferred embodiment of the controller of the subject invention.

Referring now to FIG. 3, the preferred embodiment of the controller 50 will now be discussed. More particularly, it is intended that a small sample of the flue gas expelled through exhaust 28 of the engine be continuously withdrawn and supplied to an analyzer. In a typical installation, the exhaust gas from an engine is released at an elevated temperature, on the order of 800° F. When the sample is removed from the flue, for example, via a pipe system, it is exposed to much cooler outside temperatures, causing water in the sample to condense. Engine exhaust gas will typically have 12–14% water content. In most known analyzers, condensed water present in a sample would seriously inhibit the measurement of particulates. In the preferred embodiment, which relies on the measurement of carbon monoxide particles, condensed water must be eliminated from the sample prior to measurement, to obtain accurate results.

In order to insure that water is removed, the sample is first passed through a condenser 52 which operates to further reduce the temperature of the exhaust flow to 35° to 40° F. By further reducing the temperature of the gas, a large percentage of the water in the sample will be condensed. The sample is then passed through a demister 54 for removing the liquified water generated by the condenser. The demister can be in the form of a spinner which utilizes centrifugal force to remove water from the sample.

The sample is then passed through a bubbler device 56. In a bubbler, a gaseous sample is caused to percolate or bubble up through a liquid medium which results in additional moisture being removed. In the preferred embodiment, the sample can be further conditioned by passing it through a heater 58 which insures that any small amounts of remaining water are driven back to the gaseous phase prior to its entry into analyzer 60. A pair of filters 62 may be interposed on either side of heater 58, to remove any unwanted particles unrelated to the carbon monoxide particles of interest. In the preferred embodiment, by the time the sample reaches the analyzer, it will have a moisture content of less than 1%.

As mentioned above, the analyzer of the subject invention may be an infrared detector capable of detecting carbon monoxide particulates in the sample. The output of the analyzer can be an electrical voltage which varies as a function of the particulates detected. An infrared analyzer suitable for use in the subject invention is manufactured by the Horiba Company. The Horiba analyzer can detect up to 20,000 parts per million of carbon monoxide. It will operate with an accuracy range of plus or minus 5%.

The voltage output of analyzer 60 is gated to a comparator 70. Comparator 70 is preset with a voltage level corresponding to the desired particulate level in the exhaust output. Comparator 70 functions to compare the input voltage from analyzer 60 with the preset level to determine the variance from the optimum setting. Comparator 70 then operates to generate an output signal for adjusting the fuel flow from carburetor 30. Comparator 70 may be defined by a microprocessor which is programmable with the predetermined set point. One microprocessor suitable for use with the subject invention is a 560 Series Microprocessor Controller manufactured by the Barber-Colman Company.

The output from comparator 70 is supplied to carburetor 30. Typically, the carburetor is adjusted by means of a rotatable screw. Accordingly, an electrically controlled actuator may be mounted to the carburetor for producing the air/fuel ratio adjustments. Both electric or pneumatic actuators can be used depending on the particular application. A typical actuator suitable for use with the subject invention is the Model 659 Resistance to Position Converter manufactured by the Barber-Colman Company.

In summary, there has been provided a new and improved apparatus and method for minimizing the fuel usage in an internal combustion engine. More particularly, in an internal combustion engine, subject to varying loads, a governor 24 is provided for varying fuel flow as a function of load. When the fuel flow is restricted as the result of a drop in demand, the air/fuel ratio must be readjusted to maximize efficiency. Accordingly, in the subject invention, the carbon monoxide in the exhaust 28 of an engine 20 is monitored. The particulate level is then compared to a preset level corresponding to optimum performance. A controller 50 then functions to readjust the air fuel ratio to improve the efficiency of the operation of the engine. By this arrangement, the governor is able to further reduce fuel flow, thereby minimizing fuel usage. Other advantages gained by improving the quality of combustion, include the reduction of maintenance problems and air pollution.

While the subject invention has been described with relation to a preferred embodiment, it is to be understood that various other changes and modifications could be made therein by one skilled in the art, without varying from the scope and spirit of the subject invention as defined by the appended claims.

I claim:

1. An apparatus for minimizing the fuel usage in an internal combustion engine, wherein said engine is subject to varying loads, said engine having a fuel input and an air input and an exhaust output, said engine further including a governor means, said governor means for adjusting the flow of fuel to said engine as a function of load, said apparatus comprising:

means for monitoring the combustibles in the exhaust output, said monitoring means including a condenser for condensing water contained in said exhaust output, said monitoring means further including a demister connected in line with said condenser for removing said condensed water, said monitoring means also including a bubbler connected in line with said demister for removing additional moisture from said exhaust output;

means for comparing the level of said combustibles to a predetermined value; and means for adjusting the rate of fuel from said governor to said engine in a manner such that the level of combustibles equals said predetermined value, whereby said apparatus functions to fine tune the fuel supply to said engine thereby maximizing efficiency.

2. An apparatus as recited in claim 1 wherein said monitoring means further includes a heater for raising the temperature of said exhaust for vaporizing any remaining water.

3. An apparatus as recited in claim 2 further including filter means interposed between said bubbler and heater for removing any particulates from said exhaust.

4. An apparatus as recited in claim 1 wherein said monitoring means includes an infrared analyzer.

5. An apparatus as recited in claim 4 wherein said infrared analyzer measures carbon monoxide levels in said exhaust.

6. An apparatus as recited in claim 1 wherein said comparator means includes a microprocessor.

* * * * *